United States Patent [19]

Tietjens

[11] Patent Number: 4,998,352

[45] Date of Patent: Mar. 12, 1991

[54] CUTTING UNIT FOR A SHAVING APPARATUS

[75] Inventor: Eduard W. Tietjens, Eindhoven, Netherlands

[73] Assignee: U.S. Philips Corp., New York, N.Y.

[21] Appl. No.: 356,633

[22] Filed: May 22, 1989

Related U.S. Application Data

[63] Continuation of Ser. No. 147,848, Jan. 25, 1988, abandoned.

[30] Foreign Application Priority Data

Jan. 27, 1987 [NL] Netherlands ..... 8700187

[51] Int. Cl.[5] ..... B26B 19/14

[52] U.S. Cl. ..... 30/346.51; 30/43; 30/43.6; 30/43.92

[58] Field of Search ..... 30/43.4, 43.5, 43.6, 30/43.92, 46.51, 43

[56] References Cited

U.S. PATENT DOCUMENTS

| | | | |
|---|---|---|---|
| 2,877,548 | 3/1959 | Starre | 30/346.51 |
| 3,179,543 | 4/1965 | Marcelis | 30/346.51 X |
| 3,890,705 | 6/1975 | Tietjens | 30/43.6 |
| 4,138,811 | 2/1979 | Chauvy | 30/346.51 |
| 4,151,645 | 5/1979 | Tietjens | 30/346.51 X |
| 4,343,089 | 8/1982 | Suzuki et al. | 30/346.51 |

*Primary Examiner*—Hien H. Phan
*Assistant Examiner*—Rinaldi Rada
*Attorney, Agent, or Firm*—Ernestine C. Bartlett

[57] ABSTRACT

A cutting unit for a shaving apparatus, which cutting unit comprises a cutting head with hair entrance apertures and a drivable cutting member, the hair entrance apertures being separated by dams which extend substantially transversely to the direction of driving. The dams are constructed with a profile which is asymmetrical in cross-section and has a thickness which increases in the direction of driving.

5 Claims, 1 Drawing Sheet

CUTTING UNIT FOR A SHAVING APPARATUS

This is a continuation of application Ser. No. 147,848, filed Jan. 25, 1988 now abandoned.

FIELD OF THE INVENTION

The invention relates to a cutting unit for a shaving apparatus, which cutting unit comprises a cutting head having hair entrance apertures and a drivable cutting member, the hair entrance apertures being separated by dams extending substantially transversely to the direction of the driving.

BACKGROUND OF THE INVENTION

Such a cutting unit is known, for example, from U.S. Pat. No. 3,890,705 . The dams are obtained, for example, in that the slot-shaped hair entrance apertures are sawn in a basic form of sheet material of the cutting head. During shaving, a hair which is in a hair entrance aperture is cut by the cooperation of a dam and the cutting member. The thinner the dam is constructed, the closer to the skin will a hair be cut and the better hence is the shaving result. The dimensions of a dam, in particular the thickness, however, cannot be chosen to be arbitrarily small because the dam must have sufficient rigidity, for example, for providing the reaction force necessary during cutting and to prevent the dam from bending too far inwardly as a result of the pressure upon contacting the skin to be shaved.

SUMMARY OF THE INVENTION

It is the object of the invention to provide a solution to this problem and the invention is characterized in that in cross-section a dam has an asymmetrical profile with a thickness increasing in the direction of driving.

A special embodiment is characterized in that the thickness of the dam increases stepwise in the direction of driving.

The invention will now be described in greater detail with reference to a description of a few embodiments shown in the Figures.

DETAILED DESCRIPTION OF PREFERRED EMBODIMENTS

Figure 1:
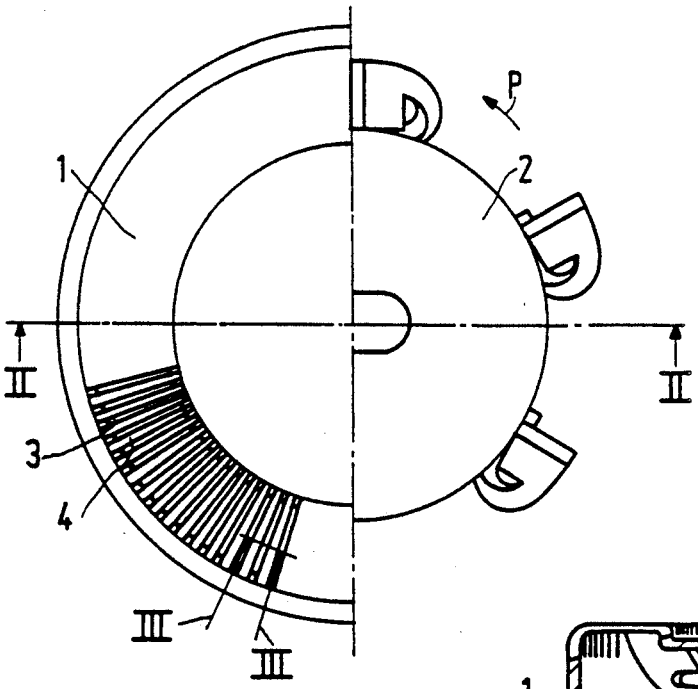
FIG. 1 is a plan view of the cutting unit in which the cutting head in the right-hand half of the Figure is omitted.
Figure 2:
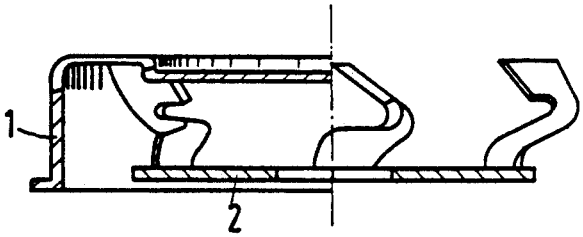
FIG. 2 is a sectional view taken on the line II—II in FIG. 1.

The cutting unit as shown in FIGS. 1 and 2 comprises a cutting head 1 and a cutting member 2. Such a unit is used in a shaving apparatus which comprises an electric driving device known per se by means of which the cutting member 2 can be driven so as to be rotating in the direction of the arrow P with respect to the cutting head 1.

The cutting head 1 comprises elongate hair entrance apertures 3 which are separated by dams 4. The hair entrance apertures 3 and the dams 4 are directed substantially radially and hence extend substantially transversely to the direction of driving P.

Figure 3:
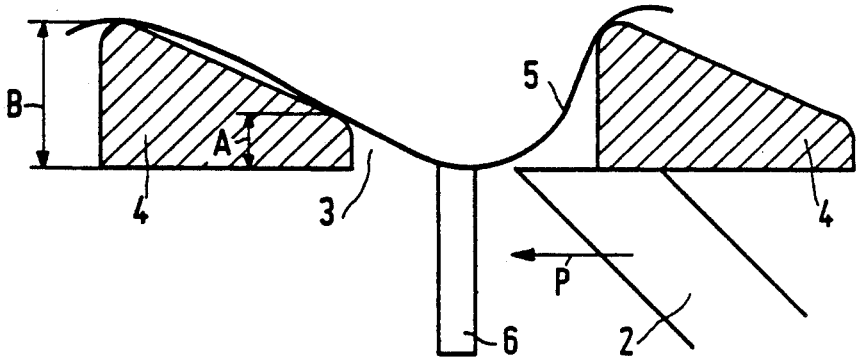
FIG. 3 shows on an enlarged scale a detail of the cutting unit in a sectional view taken on the line III—III in FIG. 1.
Figure 4:
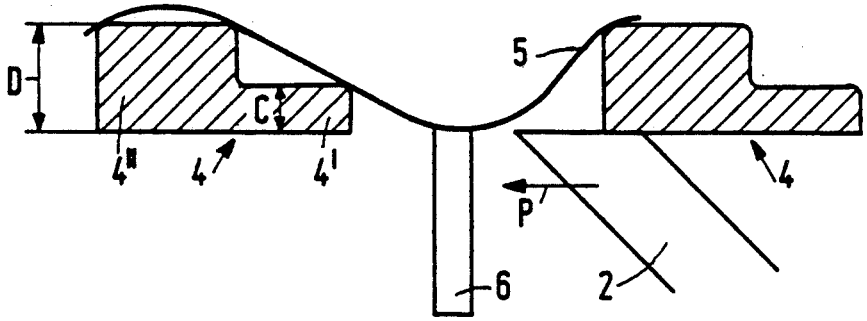
FIG. 4 shows a modified embodiment in accordance with FIG. 3.

In the embodiments shown in FIGS. 3 and 4 the dam in cross-section has an asymmetrical profile with a thickness increasing in the direction of driving P. The Figure also shows a part of the skin 5 to be shaved and a hair 6.

FIG. 3 is a substantially trapezoidal sectional view in which the thickness increases from A to B, i.e. from one end of the dam to the other. It has been found that with these dams 4 which, during shaving, move over the skin in a direction opposite to the direction of the driving P, the skin protrudes farther between the dams than in the case of the conventional lamellae of the same rigidity and a rectangular cross-section. As a result of this the hairs will be cut closer to the skin. Moreover, as a result of the protrusion of the skin, a hair 6 will be lifted up in a position transversely to the direction of driving P as a result of which the cutting result is also improved.

During shaving a part of the dams 4 will be moved over the skin in the same direction as the direction of driving P. In cutting units with the conventional dams having a rectangular cross-section it has already been found that in that case the dams squeeze the hairs present on the skin in the direction of driving as a result of which the hairs are not cut or are badly cut so that the part of the cutting unit where the dams in question are present hardly contributes to the shaving process. Any deterioration in this respect with the dams described here having an asymmetric cross-section is minimal when compared to the improvement of the shaving result which is obtained with these asymmetric dams in that part of the cutting unit where the dams move over the skin in the direction opposite to the direction of driving P.

The same advantages as described in the embodiment of FIG. 3 are also obtained in the FIG. 4 embodiment in which the thickness of the dam increases stepwise in the direction of driving P. A first dam portion 4' has a smaller thickness C than a second dam portion 4'' of thickness D. In this case also a deeper protrusion of the skin is again obtained When the lammellae move over the skin in the direction opposite to the direction of driving P. This embodiment can particularly readily be realized by means of manufacturing methods such as etching and chemical polishing.

The embodiment of the dams according to the invention can also be used with other types of cutting units, for example, with a cutting head which is constructed as a flexible cutting plate which in the curved shape is stretched around a cylindrical rotatably drivable cutting member as described, for example, in FR-PS 994,890.

What is claimed is:

1. A cutting unit for a shaving apparatus, which cutting unit comprises a cutting head with hair entrance apertures and a drivable cutting member the hair entrance apertures being separated by dams extending substantially transversely to a direction of driving (P) of the drivable cutting member and having a first end and a second end, wherein in cross-section a dam has an asymmetrical profile with a thickness which increases stepwise in the direction of driving (P) from said first end to the second end of said dam.

2. An electric shaving apparatus comprising a cutting unit having a cutting head with hair entrance apertures and a drivable cutting member, the hair entrance apertures being separated by dams extending substantially transversely to a direction of driving (P) of the drivable cutting member and having a first end and a second end, wherein in cross-section a dam has an asymmetrical profile with a thickness which increases stepwise in the direction of driving (P) from said first end to the second end of said dam.

3. A cutting unit for a shaving apparatus, which cutting unit comprises a cutting head with hair entrance apertures and a driveable cutting member, the hair entrance apertures being separated by dams extending substantially transversely to a direction of driving (P) of the driveable cutting member and having a first end and a second end closest to the direction of driving (P) wherein in cross-section a dam has an asymmetrical profile with a thickness which increases in the direction of driving (P) from said first end to the second end of the dam.

4. A cutting unit as claimed in claim 3 in which each dam is substantially trapezoidal in cross-section.

5. An electric shaving apparatus comprising a cutting unit having a cutting head with hair entrance apertures and a driveable cutting member, the hair entrance apertures being separated by dams extending substantially transversely to a direction of driving (P) of the drivable cutting member and having a first end and a second end closest to the direction of driving (P) wherein in cross-section a dam has an asymmetrical profile with a thickness which increases in the direction of driving (P) from said first end to the second end of the dam.

* * * * *